United States Patent [19]

Biggerstaff

[11] 4,080,669

[45] Mar. 28, 1978

[54] TWO-LEVEL TOILET FLUSH SYSTEM

[76] Inventor: William L. Biggerstaff, 1123 Lincoln #6, Santa Monica, Calif. 90403

[21] Appl. No.: 687,242

[22] Filed: May 17, 1976

[51] Int. Cl.[2] ..... E03D 5/04

[52] U.S. Cl. ..... 4/325; 4/386; 4/393

[58] Field of Search ..... 4/34, 67 A, 67 R, 57 R, 4/57 P, 63, 56 PCF

[56] References Cited

U.S. PATENT DOCUMENTS

| | | | |
|---|---|---|---|
| 2,214,439 | 9/1940 | Robertson | 4/DIG. 1 |
| 2,290,679 | 7/1942 | Edes | 4/67 A |
| 2,629,879 | 3/1953 | Bennett | 4/57 P |
| 3,026,536 | 3/1962 | Wood | 4/DIG. 1 |
| 3,908,203 | 9/1975 | Jackson | 4/67 A |

*Primary Examiner*—Richard E. Aegerter
*Assistant Examiner*—Frederick R. Schmidt
*Attorney, Agent, or Firm*—Harold F. Bennett

[57] ABSTRACT

A toilet flush control is provided which is capable of dispensing different amounts of water and which comprises a rod flexibly attached to the outlet valve and loosely confined at its upper end. A floating ball slides down the rod as the water level falls and pushes the valve closed for a short flush. In a particular embodiment the ball is held at the top for full flush when the toilet seat is down and is released when the toilet seat is raised.

5 Claims, 5 Drawing Figures

TWO-LEVEL TOILET FLUSH SYSTEM

BACKGROUND OF THE INVENTION

Toilet flush tanks have become highly standardized, but have some variation in size and arrangement of parts. Briefly, the tank is provided with an intake pipe and valve, a float ball, an overflow pipe, a large diameter outlet valve and actuating means for opening the outlet valve.

In normal operation, the tank is filled through the intake pipe until the intake valve is closed by action of the float ball. The water level at which this takes place is adjustable simply by bending the long lever rod which carries the float ball. The overflow pipe guards against a leaky intake valve and/or a maladjusted float. When the toilet is to be flushed the outlet valve is opened by the actuating means, allowing a sudden discharge of the water. Various types of outlet valves are currently marketed. The operational requirements are that the valve flap must remain open, e.g., by buoyance, until the water is discharged and then it must close.

In recent years it has become important to limit water usage and in this regard it is sufficient to use a smaller amount of water when only liquids are to be flushed down the toilet than when solids are to be flushed. Various methods have been proposed for providing selectively a full flush and a partial flush, for example in U.S. Pat. Nos. 3,908,203 Jackson and 3,936,889 Wibroe.

BRIEF STATEMENT OF THE INVENTION

The present invention provides a simple, inexpensive and dependable attachment or retro-fit kit, easily installed in most or all currently marketed toilet tanks, for closing the outlet valve before the water is completely discharged. According to the invention, a toilet flush control is provided which is capable of dispensing different amounts of water and which comprises a rod flexibly attached to the outlet valve and loosely confined at its upper end. A buoyant ball slides down the rod as the water level falls and pushes the valve closed for a short flush. In a particular embodiment the ball is held at the top for full flush when the toilet seat is down and is released when the toilet seat is raised.

DESCRIPTION OF PREFERRED EMBODIMENTS

Figure 1:
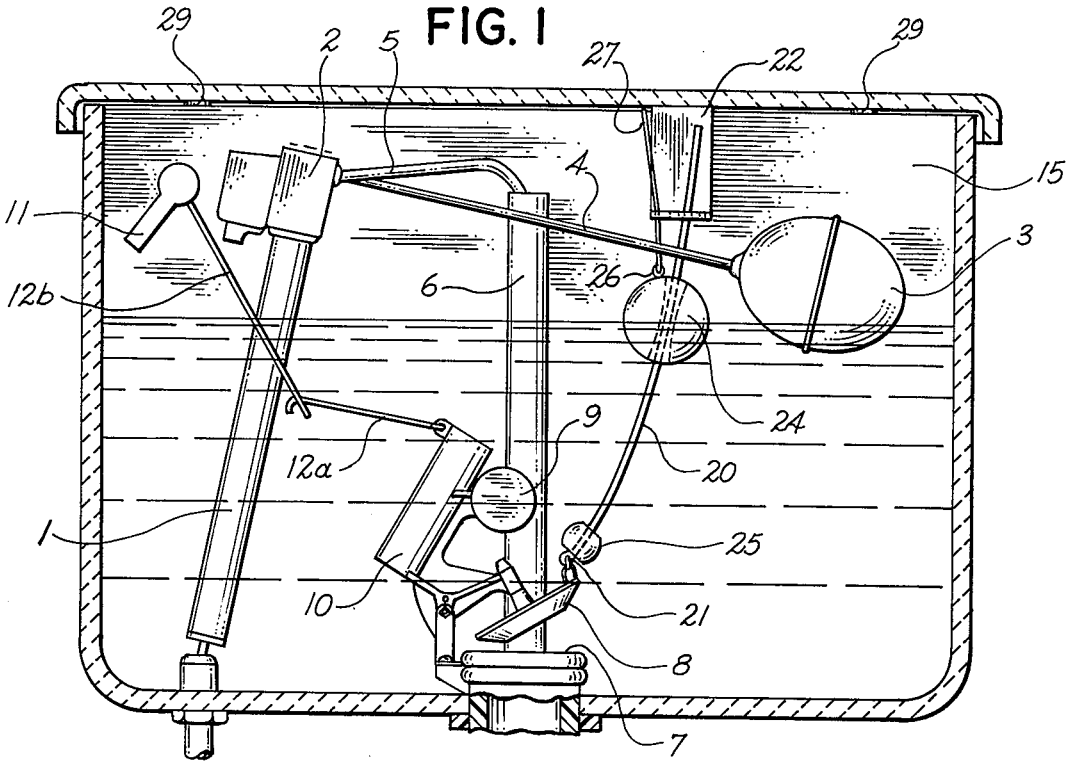
FIG. 1 is a sectional view of the interior of a toilet tank with a flush control according to the invention.

FIG. 1 is a general view of the inside of a toilet tank showing the standard parts: the intake pipe 1 with a valve 2 controlled by a float ball 3 carried on a rod 4. While the tank is refilling, water flows through a bleeder 5 into an overflow pipe 6. The outlet valve consists of a seat 7 at the bottom of the tank and a hinged flap 8 co-acting therewith. The flap is held down by water pressure until the lever 11 is actuated and pulls through linkage **12*a* and 12*b*** to lift the flap, as shown.

The flap is held open against hydrostatic and/or hydrodynamic forces by the buoyance of a hollow cylinder 9 to the right of the fulcrum and the downward force of the weight of a leaky cup 10 to the left until the cup 10 empties. At that time the cylinder 9 is above the water, and its weight along with that of the valve parts closes the valve 8 against seat 7.

According to the invention, a light weight rod or stiff tube 20 is attached to the ring 34 normally provided on the valve flap 8 by a chain link or ring 21 or the like (see FIG. 5) and is loosely confined at the top by a bracket 22 provided with a hole 23 (FIG. 2) through which the rod 20 extends. A buoyant ball 24 is disposed to slide loosely on the rod 20 so as to press on the flap 8 before the tank is completely emptied. Optionally a collar 25 is slipped onto the rod below the ball 24 to decrease the volume of water used in the small flush by causing the descending ball to close the valve sooner. The person installing the device selects a collar of appropriate length to adjust the amount of water used in the small flush, and this is not easily tampered with by the householder. Speaking more accurately, the difference between the full flush and the partial flush is readily set in this way, and it can also be set to some degree by selecting a ball of suitable size.

According to a particular feature of the invention, a string 27 is attached to the ball 24 and is passed over the top edge of the tank for optionally inactivating the flush control as will be described in more detail with reference to FIGS. 2 and 3.

Figure 2:
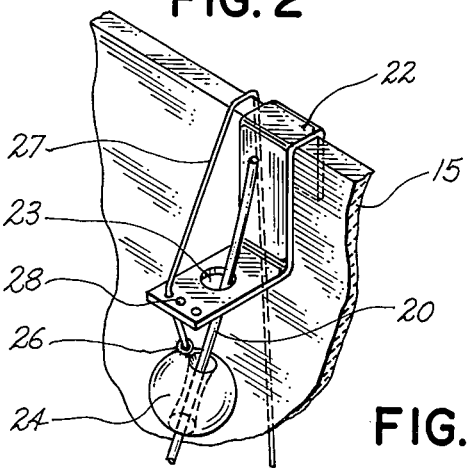
FIG. 2 is a detail of the upper part of the flush control.

FIG. 2 is a detail of the upper part of the flush control in perspective showing the ball 24, the rod 20 (in part) and the bracket 22 clipped over the back wall 15 of the tank and provided with hole 23 for constraining the upper end of rod 20, substantially as in FIG. 1. It also shows the string 27 attached to ball 24 by screw or screw eye 26 and passing up through a small hole 28 in the bracket 22 and thence over the back wall 15 of the tank. The screw 26 should be positioned to minimize friction between the ball and the rod. Assuming that there is space between the tank and the wall (as is true in most cases) the string 27 passes thence down behind the tank and crosses under the tank to the front. If necessary, pads 29 (FIG. 1) provide space for the string.

Figure 3:
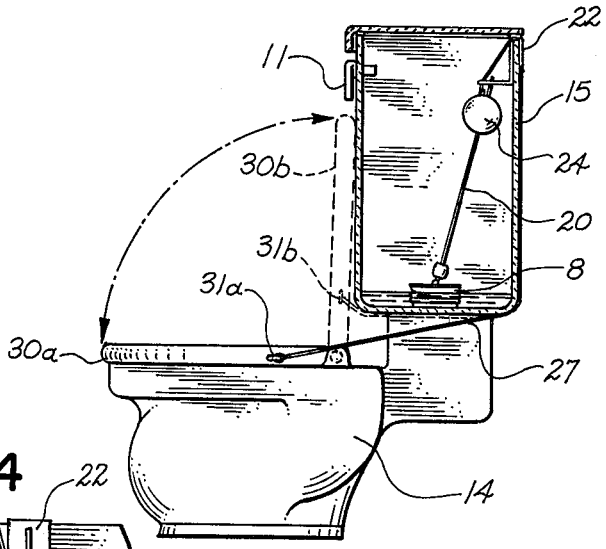
FIG. 3 is a side view of a toilet, partly sectioned, showing means of inactivating the flush control when the toilet seat is lowered.

FIG. 3 is a partial view with the tank emptied. It shows the lower end of string 27 attached to the toilet seat **30*a* in the lowered position by a tack or screw 31*a* or the like. In the lowered position the string is held tightly enough to support ball 24 and to prevent it from closing the outlet valve 8 early. However, when the seat is in the raised position 30*b* there is enough slack to allow ball 24 to descend and close valve flap 8** so that only a partial flush will occur.

Figure 4:
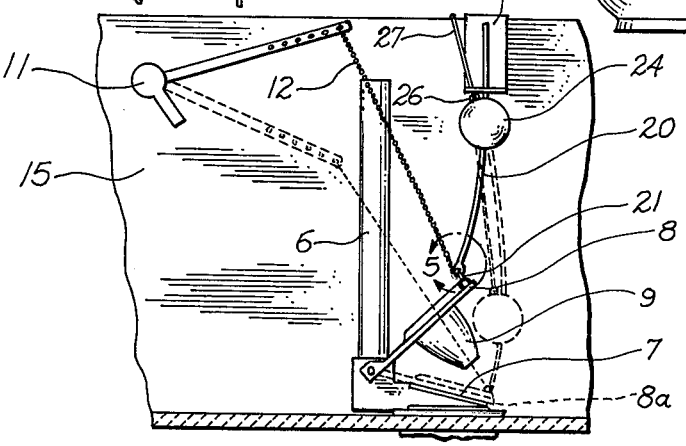
FIG. 4 is a partial view showing the flush control installed on a different type outlet valve.

FIG. 4 is a partial view showing the flush control attached to a different style of outlet valve. The reference numerals agree in general with FIG. 1. The valve seat 7 is sloping in this case and the valve flap 8 is made of flexible rubber. The buoyance is provided by a hollow appendage 9 provided with a hole for draining water out of it when the flap is in the closed position **8*a*. The opening of the valve is effected by pulling upward on chain 12. The rod 20 is attached to flap 8 in a similar manner to that shown in FIG. 1 and is constrained at the upper end by bracket 22 as before. Ball 24 and string 27 operate as previously described. The two types of outlet valve assemblies are shown for the purpose of bringing out the adaptability of the flush control. In FIG. 1 the rod 20 is bowed so that ball 24 stays clear of float 9 as it descends. Also, the bracket 22 can be clipped to the wall of the tank in a suitable position along the wall to provide a free path for ball 24** in all of the mechanical configurations thus far encountered in practice.

Figure 5:
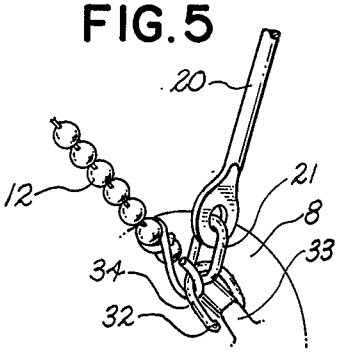
FIG. 5 is a detail of the connection of the actuating chain and the rod to the outlet valve.

FIG. 5 is a detail showing more clearly the manner of attaching the chain 12 and the rod 20 to the valve flap 8 of FIG. 4, by way of example. The rod is preferably held by a single ring 21 to the ring 34 normally attached to the tab or rib 33 on top of flap 8. This gives enough flexure so that the rod 20 does not directly interfere with the action of the valve flap 8. On the other hand, experience has shown that a longer chain segment connecting the rod 20 to the flap 8 allows too much play and results in unpredictable amounts of water being retained in the tank at the end of a short flush.

The flush control according to the invention has operated successfully on several standard types of tanks. The preferred embodiment has the advantage that it flushes with the appropriate amount of water in the majority of instances without any thought on the part of the user, since men usually urinate with the seat in the raised position.

An illustrative embodiment of the invention has been described in two adaptations to commercially available mechanisms. However, it is to be understood that the invention is not limited to the specific structural details shown.

I claim:

1. In a toilet mechanism having a seat selectably positioned between a lowered position and a raised position and a flush tank, the flush tank including means for filling the tank to a predetermined level, an outlet valve adapted to remain open when actuated until said tank is substantially empty to provide a full flush of said tank, and actuating means for opening said outlet valve to flush said tank, means for aborting a full flush of said tank comprising:

a guide member attached to said outlet valve and constrained in a generally vertical position, a buoyant body adapted when unrestrained to slide freely on said member and to descend while the water level in said tank lowers, and a fixed-length connector coupled between the toilet seat and said buoyant body and adapted to transmit a restraining force from said seat to said buoyant body when said seat is in its lowered position for preventing the descent of said buoyant body along said guide member as the water level in said tank decreases thus allowing a full flush of said tank and adapted to be relaxed when said seat is in its raised position for permitting the descent of said buoyant body as the water level in said tank decreases to provide a closing force on said valve when said seat is in its raised position which force closes said valve sooner than it would for a full flush condition of said tank to provide for less than a full flush of said tank.

2. In a toilet system having a waste receptacle, a water reservoir, water inlet means for filling said water reservoir to a predetermined level, a water outlet passage in said reservoir, sealing means for normally sealing the outlet passage, flush control means connected to the sealing means for opening the outlet passage for permitting said reservoir to drain and flush the waste receptacle, and a seat in operative association with the waste receptacle and having a raised and a lowered position, the improvement comprising:

water saver means comprising a buoyant body within said reservoir adapted to exert force upon said sealing means during a toilet flush to seal said outlet passage sooner than normal, and a fixed-length connector attached to said buoyant body and to said seat and constrained in a path such that said seat holds said connector under tension when in said lowered position to stop said buoyant body from exerting force upon said sealing means and allows slack when in said raised position to permit said body to exert said force upon said sealing means, whereby less water is used to flush said waste receptacle when said seat is in said raised position than when said seat is in said lowered position.

3. In a toilet system having a waste receptacle, a water reservoir, water inlet means for filling said water reservoir to a predetermined level, a water outlet passage in said reservoir, sealing means for normally sealing the outlet passage, flush control means connected to the sealing means for opening the outlet passage for permitting said reservoir to drain and flush the waste receptacle, and a seat in operative association with the waste receptacle and having a raised and a lowered position, the improvement comprising:

water saver means including a buoyant body within said reservoir, means for guiding said body along a path which intercepts said sealing means, and a fixed-length connector coupling said body to said seat, said connector being held under tension when said seat is in said lowered position but not when in said raised position permitting said body to travel along said path to make contact with said sealing means when both (1) the water level of said reservoir is decreasing as a result of activation of said flush control means and (2) said seat is in said raised position but not in said lowered position, to thereby allow said body to exert a closing force component upon said sealing means only when said seat is in said raised position whereby less water is utilized to flush said receptacle when said seat is in said raised position than in said lowered position.

4. In a toilet comprising a toilet seat selectively positionable horizontally and vertically, a toilet flush tank provided with means for filling to a predetermined level and outlet means for normally emptying said tank into said toilet, THE COMBINATION OF:

means for aborting the action of said outlet means whereby a predetermined amount of water is retained in said tank; and inactivating means comprising a fixed length connector connected to said aborting means and to said seat and held taut by said toilet seat in said horizontal position but not in said vertical position for selectively inactivating said aborting means when seat is in said horizontal position and permitting said aborting means to abort the flush when said seat is in said vertical position whereby less water is used to flush said toilet when said toilet seat is in its vertical position.

5. A kit for converting a toilet having a standard toilet flush tank into a two-level flush system, comprising:

a member adapted when installed to extend substantially upwardly from the outlet valve of said tank;

means for attaching said member to said outlet valve;

means for supporting the upper end of said member;

a buoyant body adapted, when unrestrained, to slide freely on said member for descending along said member while said tank is emptying for providing a closing force on said outlet valve before said tank is completely emptied; and a string and means for attaching a suitable length of said string between said body and the seat of said toilet for selectively controlling the ability of said body to descend along said member by said seat holding said string more tightly when said seat is in a lowered position than when it is in a raised position.

* * * * *